US005415022A

United States Patent [19]

Bakermans et al.

[11] Patent Number: 5,415,022

[45] Date of Patent: May 16, 1995

[54] MODULAR TOOLING BOX WITH A REMOVABLE COVER FOR A STAMPING AND FORMING MACHINE

[75] Inventors: Johannes C. W. Bakermans; Daniel E. Poplaski, both of Harrisburg, Pa.

[73] Assignee: The Whitaker Corporation, Wilmington, Del.

[21] Appl. No.: 155,977

[22] Filed: Nov. 19, 1993

[51] Int. Cl.[6] ..... B21D 37/12

[52] U.S. Cl. ..... 72/456; 72/407; 72/450; 83/623; 83/687

[58] Field of Search ..... 72/402, 403, 405, 407, 72/427, 450, 456; 83/133, 134, 140, 620, 623, 687

[56] References Cited

U.S. PATENT DOCUMENTS

| | | | |
|---|---|---|---|
| 4,497,196 | 2/1985 | Bakermans et al. | 72/405 |
| 4,819,476 | 4/1989 | Bakermans et al. | 72/456 |
| 4,934,173 | 6/1990 | Bakermans et al. | 72/407 |
| 5,007,282 | 4/1991 | Bakermans | 72/481 |
| 5,321,969 | 6/1994 | Bakermans | 72/407 |

*Primary Examiner*—David Jones

[57] ABSTRACT

A stamping and forming machine is disclosed having two operating modules, each of which has a punch assembly and a mating die assembly that reciprocate horizontally toward and away from each other for performing stamping and forming operations. The punch and die assemblies reciprocate within a passageway formed by a tool box comprising a base plate, two side plates screwed to the base plate, and a cover plate that is removably attached to the side plates. The cover plate is attached by means of dovetails that are formed in the outside edges of the side plates and the cover plate. The dovetails are spaced so that when the dovetail halves on one side of the cover and a respective side plate are in mating engagement, the other dovetail half on the cover is spaced from the dovetail half on the other side plate. A removable gib is arranged to closely fit in this space so that there is no appreciable lateral play between the cover and the side plates. The cover is removed by first sliding the gib out of the space, moving the cover laterally a small amount to break the oil film, then lifting the cover straight up. The cover is reassembled by lowering it onto the top surfaces of the side plates, sliding it to one side to mate the two dovetail halves, then inserting the gib into the space between the other two dovetail halves.

24 Claims, 4 Drawing Sheets

MODULAR TOOLING BOX WITH A REMOVABLE COVER FOR A STAMPING AND FORMING MACHINE

The present invention relates to tooling modules for a stamping and forming machine wherein the cover of the module is easily removable for quick access to the punch and die assemblies for replacement or maintenance.

BACKGROUND OF THE INVENTION

U.S. Pat. Nos. 4,497,196 and 4,819,476, both of which are incorporated herein by reference, disclose a stamping and forming machine having first and second ram assemblies which are reciprocable toward and away from each other along horizontal paths of reciprocation. Strip material is fed along a strip feed path which extends between the ram assemblies. The ram assemblies have tooling on their ends for performing stamping and forming operations on the strip. The ram assemblies are reciprocated by oscillating levers to which the are coupled. The levers, in turn, are coupled to a central power shaft by eccentric assemblies. One example of typical punch and die tooling for use in a stamping and forming machine is disclosed in U.S. Pat. No. 5,007,282, which is incorporated herein by reference.

Another typical tooling assembly 10, as disclosed in the '476 patent, is shown in FIG. 1. Note that the view in FIG. 1 is an end-view with the direction of reciprocation being perpendicular to the paper. The tooling assembly 10 includes a base plate 12, two side plates 14 and 16, and a removable cover plate 18. The two side plates 14 and 16 are attached to the base plate 12 by means of screws 20 to form a rigid U-shaped member. The top outer edges of the two side plates have rabbets 22 and 24 formed therein. The cover plate 18 has a pair of flanges 26 and 28 extending from is downwardly facing surface 30 that straddle the two side plates and are in slip fit engagement with the walls of the rabbets 22 and 24. The inner walls of the U-shaped member and the surface 30 form a passageway within which the punch and die assemblies reciprocate. A punch ram 32, which is moved by an oscillating lever 34 as described above, is shown in the passageway. The cover plate 18 is secured in place by means of the knurled head screws 36, which are threaded into the two side plates 14 and 16. When it is desired to access the punch and die assemblies for sharpening or for other reasons, the screws 36 and the cover plate 18 are removed. Since the punch and die assemblies are in sliding contact with the surface 30 of the cover and there is a film of lubricant between the surfaces, atmospheric pressure prevents the easy separation of the cover from the punch and die assemblies. The conventional way of removal is to slide the cover in the direction of reciprocation along the rabbets 22 and 24 a short distance to break the oil film then lift the cover straight up. In some cases there are stop blocks attached to the surface 30 that interact with the tooling assemblies to perform certain functions. These stop blocks may limit movement of the cover so that it is difficult to break the oil film. Due to the weight of the cover, about 65 pounds, and the close fit between the flanges 26, 28 and the rabbets 22, 24, it is very difficult to reassemble the cover 18 to the tooling assembly. A guiding mechanism would be expensive to make since there is only about 0.0001 inch clearance between the parts. What is needed is a cover plate that is easily removed and reassembled and yet that is very precisely aligned with the tooling assembly when attached thereto.

SUMMARY OF THE INVENTION

A tooling module is disclosed for a stamping and forming machine of the type having horizontally disposed reciprocating tooling. The module includes a tooling box having an opening with its axis disposed substantially horizontally. A punch assembly and a mating die assembly are arranged to undergo reciprocating motion within the opening toward and away from each other along the axis for performing a stamping and forming operation on a workpiece disposed therebetween. The tooling box comprises a U-shaped portion defining three sides of the opening and a cover plate removably attached to the U-shaped portion, the cover plate having a fourth surface defining a fourth side of the opening. Attachment means for effecting the removable attachment of the cover plate is provided and includes four dovetail halves. A first dovetail half is formed in a first portion of the U-shaped portion and a first mating dovetail half is formed in the cover plate. A second dovetail half is formed in a second portion of the U-shaped portion and a second mating dovetail half is formed in the cover plate and spaced from the first mating dovetail half so that when the first and first mating dovetail halves are in mated engagement the second and second mating dovetail halves are spaced apart. A gib is disposed within the space between the second and second mating dovetail halves and arranged so that there is no appreciable lateral play between the cover plate and the tooling box when the cover plate is attached to the U-shaped portion.

DESCRIPTION OF THE PREFERRED EMBODIMENT

Figure 1:
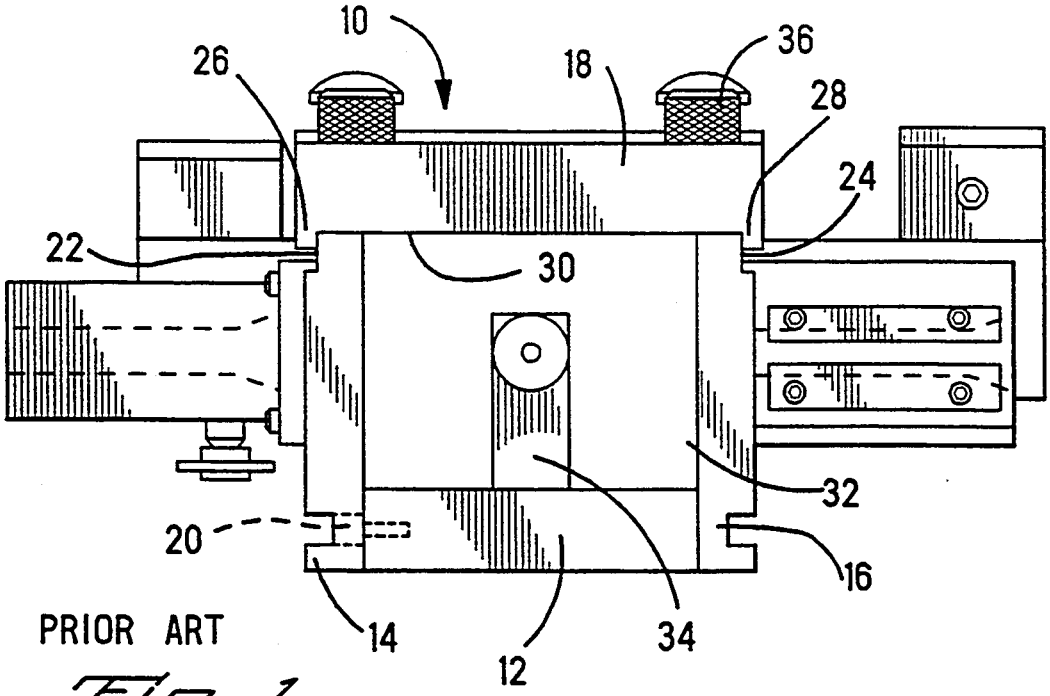
PRIOR ART Fig. 1
FIG. 1 is an end view of a prior art tooling assembly.
Figure 2:
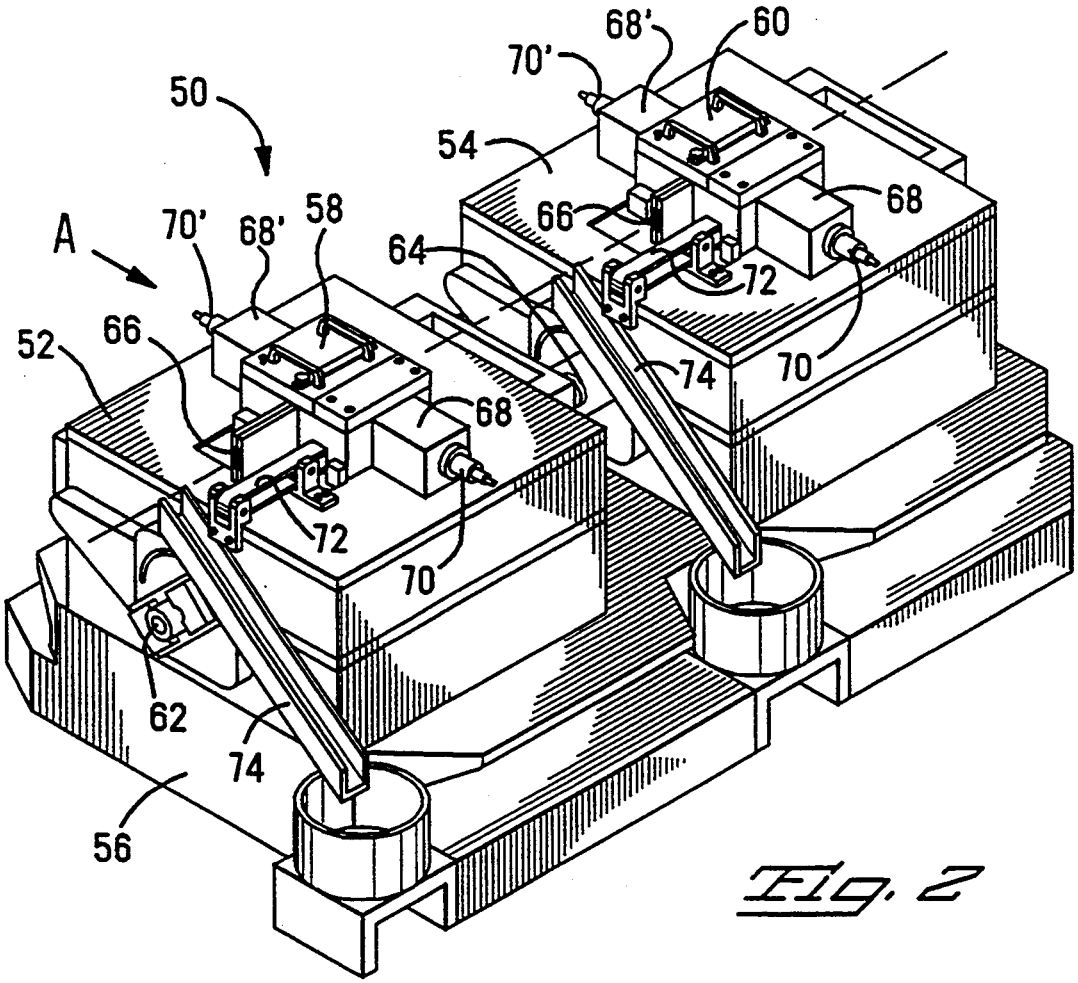
FIG. 2 is an isometric view of a two module stamping and forming machine incorporating the teachings of the present invention.

There is shown in FIG. 2 a stamping and forming machine 50 having a first stamping and forming module 52 and a second stamping and forming module 54. The first and second modules 52 and. 54, are mounted to a machine base 56 and arranged in ways so that their relative spacing can be adjusted when the machine is set up for a particular job. This means of adjustment is provided to assure that the tooling in the first module will be in proper alignment with respect to the tooling in the second module so that a strip having operations performed on it in the first module will be in proper alignment in the second module for further operations there. The modules 52 and 54 have first and second tooling assemblies 58 and 60, respectively, mounted to their top mounting plates, as shown in FIG. 2. Each module has a drive shaft 62 and an electric motor, not shown, for rotating the drive shaft during operation of the machine. The motor is coupled to the drive shaft 62 by means of a belt and pulley in the usual manner. The two drive shafts 62 are rotationally coupled together by a coupling assembly 64. Each tooling assembly 58 and 60 includes a pair of opposing ram assemblies which contain tooling on their ends which mate to perform the stamping and forming operation on strip stock that is fed through aligned slots 66. The opposing ram assemblies of each module are arranged to reciprocate toward and away from each other along horizontal paths. The rams are caused to reciprocate by means of first and second levers 68 and 68' which are coupled to their respective rams as shown at 70 and 70'. Each lever 68, 68' is pivoted intermediate its ends while its lower end is coupled to the drive shaft 62 by means of a pair of eccentrically coupled links, not shown. A scrap removal belt 72 is arranged to carry scrap slugs from the stamping operation out of the tooling assemblies and deposit them into a shoot 74 which directs the scrap to a suitable container as shown in FIG. 2.

Figure 3:
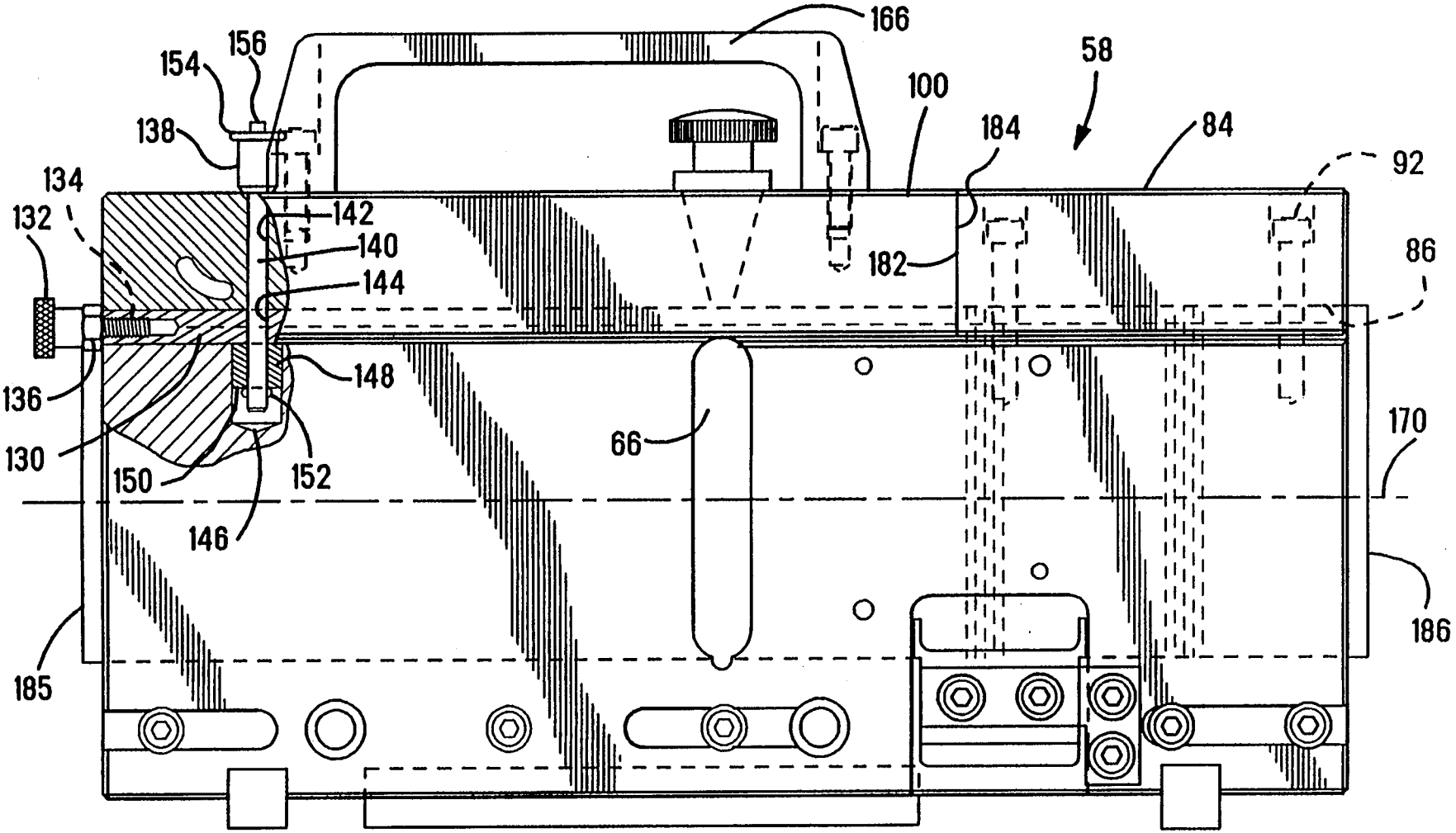
FIG. 3 is a front view of a tooling assembly incorporating the teachings of the present invention.
Figure 4:
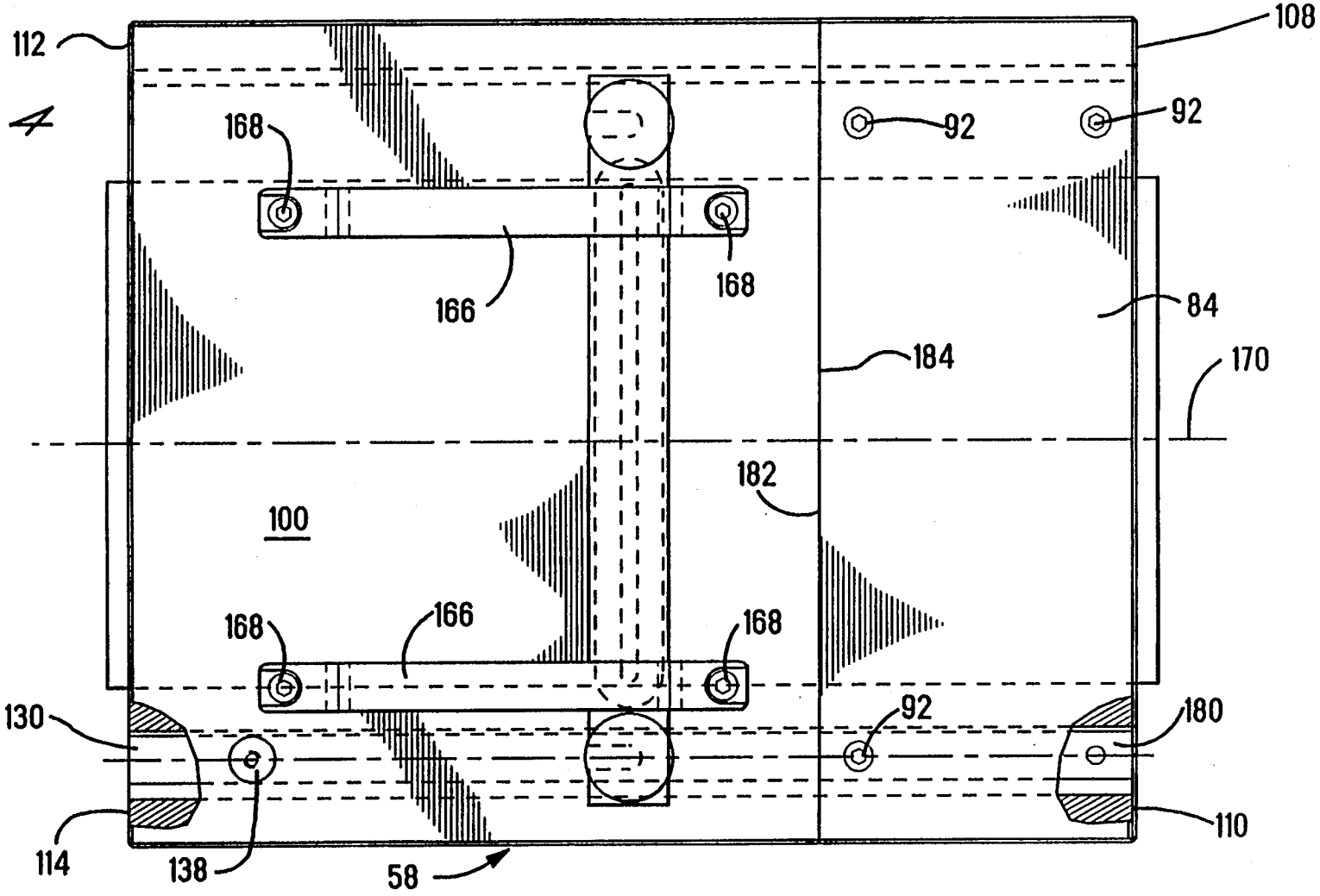
FIG. 4 is a plan view of the tooling assembly shown in FIG. 3.
Figure 5:
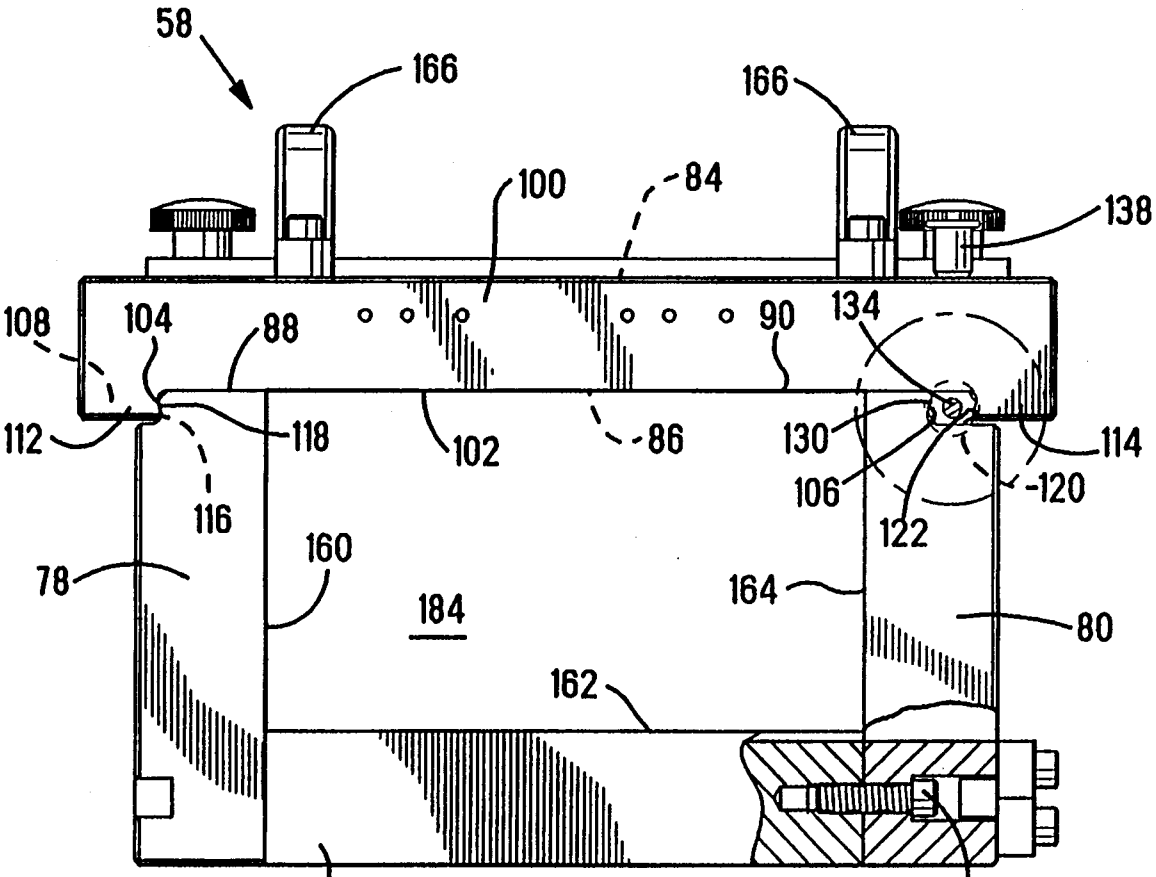
FIG. 5 is an end view of the tooling assembly shown in FIG. 3.

The tooling assembly 58 will now be described in more detail. It will be understood that the tooling assembly 60, although not identical, is arranged and functions in a similar manner as the tooling assembly 58 and therefore will not be described here. The tooling assembly 58, as seen in FIGS. 3, 4, and 5, is shown exclusive of the module 52 and the first and second levers 68 and 68'. The tooling assembly 58 includes a base 76 that is keyed and secured to the module 52 by screws in the usual manner. A left side plate 78 and a right side plate 80 are attached to opposite edges of the base 76 by means of the screws 82, as best seen in FIG. 5. A top plate 84 having a flat surface 86 is attached to top mounting surfaces 88 and 90 of the first and second side plates by means of four screws 92. The top plate 84 only covers a portion of the top surfaces of the first and second side plates, as best seen in FIGS. 3 and 4. The remaining portion is covered by a cover plate 100 having a flat surface 102 which is coplanar with the surface 86. The cover plate 100 is removably attached to the top surfaces 88 and 90 of the front and rear plates by two sets of dovetail halves as shown in FIG. 5, the two halves of each set being mutually opposing. The outer top edges of both the first and second side plates 78 and 80 have dovetail halves 104 and 106, respectively, formed outwardly along their entire lengths. The surfaces 86 and 102 of the top plate 84 and cover plate 100 are both recessed, as best seen in FIG. 5, thereby forming first and second flanges 108 and 110, respectively, in the top plate and first and second flanges 112 and 114, respectively, in the cover plate. The top plate 84 and the cover plate 100 each have a dovetail half 116 and 118, respectively, near one edge thereof that mate with the dovetail half 104 in the first side plate 78. Additionally, the top plate and the cover plate each have an oppositely formed dovetail half 120 and 122, respectively, near the opposite edge thereof that are spaced from and oppose the dovetail half 106 in the second side plate 80.

Figure 6:
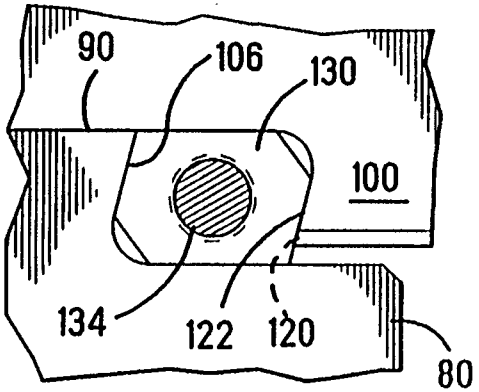
FIG. 6 is an enlarged view of a portion of the view in FIG. 5 showing the gib and related dovetail.

A gib 130 is disposed within the space between the opposing dovetail halves 106 and 122 as shown in FIGS. 5 and 6, and extends for substantially the entire length of the cover plate 100. The gib 130 is sized so that it is a light press fit within the space and engages the two dovetail halves 106 and 122 so that there is no appreciable play between the cover plate 100 and the first and second side plates 78 and 80. When the gib 130 is in place the surface 102 of the cover plate 100 is in engagement with the surfaces 88 and 90 of the two side plates 78 and 80. A knurled knob 132, used for removing the gib 130, has a stud 134 projecting therefrom that is threaded into a hole in an end of the gib and secured in place with a lock nut 136. The surfaces of the gib that engage the surfaces of the dovetail 2 halves are smooth and well lubricated so that the gib can be removed or reinserted with a moderate force of about four or five pounds applied in the direction of the longitudinal axis of the gib. With such a light press fit, the gib 130 may tend to vibrate out under normal operation of the machine 50. Therefore, the gib 130 is held in place by means of a ball lock pin 138 having a shank 140 that extends through a hole 142 in the cover plate 100, a hole 144 in the gib 130, and a blind hole 146 in the surface 88 of the first side plate 78. All of these holes are in precise axial alignment. The blind hole 146 has a hardened steel sleeve 148 pressed thereinto with a downwardly facing shoulder 150. A spring loaded ball 152 projects outwardly from a side of the end of the shank 140 and engages the shoulder 150 thereby holding the lock pin 138 securely in the holes 142, 144, and 146. The lock pin 138 has an enlarged head 154 for grasping, and an axially disposed push rod 156 that, when depressed, will retract the ball 152 thereby permitting the removal of the ball lock pin 138 by simply pulling it straight out of the holes. The ball lock pin 138 is commercially available from Reed Tool Supply Co. of Muskegon, Mich. 49444.

The width of the space between the dovetail halves 106 and 122 is large enough so that when the gib 130 is removed, the cover plate 100 can be lifted vertically away from the rest of the tooling assembly without any interference between the opposing dovetail halves. A pair of handles 166 are attached by means of screws 168 to the top surface of the cover plate 100 to aid in the manual removal of the cover plate. The base plate 76, and the first and second side plates 78 and 80 form a U-shaped member having first, second and third interior surfaces 160, 162, and 164, respectively, that are square and, along with the surfaces 86 and 102, form a passageway having a longitudinal axis 170 that is disposed horizontally with respect to the machine 50. The punch and die tooling assemblies of the module 58 reciprocate within this passageway along the horizontal axis 170. As with the prior art module 10, in some cases there are stop blocks or other features, not shown, on the surface 102 that interact with the tooling assemblies to perform certain functions. This necessitates that the cover plate 100 be very accurately aligned to the rest of the tooling module 58. Additionally, as with the module 10, during removal of the cover these stop blocks may limit its movement in the direction of the axis 170.

The top plate 84, while being attached to the side plates 78 and 80 by the screws 92 as stated above, is precisely located by means of the dovetail halves 104 and 106 in a manner similar to that of the cover plate 100. A second gib 180 is disposed within the space between the opposing dovetail halves 106 and 120 and extends for substantially the entire length of the top plate 84. The gib 180, having a cross section that is identical to that of the gib 130, is sized so that it is a light press fit within the space and engages the two dovetail halves 106 and 120 so that there is no appreciable play between the top plate 100 and the first and second side plates 78 and 80, with the screws 92 loose. The screws 92 extend through clearance holes in the top plate and the gib 180 and into threaded holes in the first and second side plates 78 and 80. Only two of these screws pass through clearance holes in the gib. The top plate 84 includes a locating surface 182 that is square with the horizontal axis 170 and serves to locate the cover plate 100 when it is reassembled to the U-shaped member after removal. The cover plate has an end 184 that is square with the axis 170 that abuts against the surface 182 when it is slid into place. Since the top plate 84 and the cover plate 100 have identical cross sections, it is advantageous to make them as one piece and then cut them into two separate pieces with wire EDM or other suitable means. Additionally, the two gibs 130 and 180, having identical cross sections, can be made as a single piece and then separated in a similar manner. The advantage in making these parts as one piece and then separating them is that dimensional variations between the parts that could cause fitting and assembly problems are eliminated.

As shown in FIGS. 3 and 4, a punch ram 185 and a die ram 186 are positioned within the passageway defined by the U-shaped member and the top plate and the cover plate. The rams are coupled to the levers 68' and 60 by means of the couplers 70' and 70, respectively. The two rams are coupled to tooling such as punches, dies, and various kinds of forming tools that operate on strip material that is passed through the opening 66. The rams 185 and 186 and their coupled tooling are a slip fit with the passageway and reciprocate therewithin along the horizontal axis 170. When it is desired to sharpen a die plate or to replace or maintain the tooling contained within the tooling assembly 58, the drive shaft 62 is positioned so that the tooling is in its fully retracted position. The push rod 156 is then depressed and the ball lock pin is removed. The gib 130 is then slid completely out of the tooling assembly. The cover plate 100 is then slid sideways in the space vacated by the gib 130 to break the oil film on the parts and then lifted by the handles 166 vertically away from the rest of the tooling assembly. The desired repair is then made and the cover plate 100 reassembled by lowering it into position on the first and second side plates, sliding it into engagement with the locating surface 182 and the dovetail half 104, then inserting the gib 130 and the lock pin 138. This process of removing or reassembling the cover plate can be accomplished in one minute or less, where it took about ten minutes to perform the same function with the prior art cover plate.

It will be understood that, while the top plate 84 is permanently screwed to the side plates 78 and 80, in the present example, the cover plate 100 could span the entire length of the side plates 78 and 80 thereby rendering the top plate unnecessary. Additionally, it will be understood that the opposing dovetail pairs 104,118 and 106, 122 can be reversed in that the dovetail halves 104 and 106 can be formed in the ends adjacent the surfaces 160 and 164 respectively but would take the shape of the present dovetail halves 118 and 122 respectively. In this case the dovetail halves 118 and 122 would also be reversed in a similar manner.

An important advantage of the present invention is that the cover plate is easily and quickly removed to provide needed access to the punch and die tooling within the tooling assembly and then quickly reassembled. This is accomplished while maintaining very accurate alignment of any stop blocks or other features on the surface 102 that interact with the reciprocating tooling assemblies. Further, when reassembling the cover it is lowered onto the mounting surfaces of the side plates with the removed so that there is sufficient clearance between the opposing dovetail halves to reduce the chance of inadvertently damaging the locating surfaces.

We claim:

1. A tooling module for a stamping and forming machine of the type including a tooling box having an opening with an axis disposed substantially horizontally, said module including a punch assembly and a mating die assembly arranged to undergo reciprocating motion within said opening toward and away from each other along said axis for performing a stamping and forming operation on a workpiece disposed therebetween, said tooling box comprising a U-shaped portion defining three sides of said opening and a cover plate removably attached to said U-shaped portion, said cover plate having a fourth surface defining a fourth side of said opening, and attachment means for effecting said removable attachment of said cover plate, said attachment means comprising:

(1) a first dovetail half formed in a first portion of said U-shaped portion and a first mating dovetail half formed in said cover plate;

(2) a second dovetail half formed in a second portion of said U-shaped portion and a second mating dovetail half formed in said cover plate spaced from said first mating dovetail half so that when said first and first mating dovetail halves are in mated engagement said second and second mating dovetail halves are spaced apart; and (3) a gib disposed within the space between said second and second mating dovetail halves and arranged so that there is no appreciable lateral play between said cover plate and said tooling box when said cover plate is attached to said U-shaped portion.

2. The tooling module according to claim 1 wherein said first, second, third, and fourth sides of said opening are in slip fit engagement with surfaces of said punch and die assemblies.

3. The tooling module according to claim 2 wherein said opening is of rectangular cross section.

4. The tooling module according to claim 1 wherein said gib is a light press fit within said space between said second and second mating dovetails and arranged so that it is removable from said space by application of a specific force to said gib in its longitudinal direction parallel with said axis so that said gib moves in said direction, said specific force being sufficient to overcome the friction of said light press fit.

5. The tooling module according to claim 4 wherein said specific force is between about one pound and about ten pounds.

6. The tooling module according to claim 1 including means arranged to releasably hold said cover plate, said gib, and said second portion of said U-shaped member mutually stationary in a direction parallel with said axis when said cover plate is attached to said U-shaped portion.

7. The tooling module according to claim 6 wherein said means for releasably holding includes a hole in each of said cover plate and said gib and a hole in said second portion of said U-shaped member, said three holes arranged to be in mutual communication and alignment when said cover plate is attached to said U-shaped member, and a pin disposed within said three holes in slip fit engagement therewith.

8. The tooling module according to claim 7 wherein said pin includes a feature thereon that engages a shoulder in said hole in said second portion.

9. The tooling module according to claim 8 wherein said feature on said pin is a spring loaded ball projecting from a side of said pin and said shoulder is an end of a bushing pressed into said hole.

10. The tooling module according to claim 1 wherein said U-shaped member includes a base plate and first and second upstanding spaced apart side plates cantilevered from said base plate and wherein said first portion of said U-shaped member is a free end of said first side member and said second portion of said U-shaped member is a free end of said second side mender, said free ends having mutually coplanar mounting surfaces that are coplanar with said fourth side of said opening.

11. The tooling module according to claim 10 wherein said forth surface of said cover plate is against said mounting surfaces when said cover plate is attached to said U-shaped member.

12. The tooling module according to claim 11 wherein said first and second dovetails are on opposite sides of said free ends of said first and second side members and wherein said cover plate has a pair of spaced apart flanges extending downwardly from said fourth surface, said pair of flanges straddling said free ends of said first and second side members, each flange having one of said first and second mating dovetail halves formed therein so that said first and first mating dovetails are in opposing relationship and said second and second mating dovetails are in opposing relationship.

13. A tooling module for a stamping and forming machine of the type including a tooling box having an opening with an axis disposed substantially horizontally, said module including a punch assembly and a mating die assembly arranged to undergo reciprocating motion within said opening toward and away from each other along said axis for performing a stamping and forming operation on a workpiece disposed therebetween, said tooling box comprising;

(a) a base plate having a first surface that is horizontally disposed;

(b) a first side plate attached to said base plate, having a second surface adjacent said first surface;

(c) a second side plate attached to said base plate, having a third surface adjacent said first surface in opposing spaced relation with said second surface;

(d) a cover plate removably attached to said first and second plates in secured engagement therewith, having a fourth surface in opposing spaced relation with said first surface;

(e) attachment means for effecting said removably attaching of said cover plate to said first and second side plates comprising:

(e1) a first dovetail half formed in an edge of said first side plate opposite said first surface and a first mating dovetail half formed in said cover plate;

(e2) a second dovetail half formed in said second side plate and a second mating dovetail half formed in said cover plate and spaced from said first mating dovetail half so that when said first and first mating dovetail halves are in mated engagement said second and second mating dovetail halves are spaced apart;

(e3) a gib disposed within the space between said second and second mating dovetail halves and arranged so that there is no appreciable lateral play between said cover plate and said first and second side plates when said cover plate is in said secured engagement; and (e4) means arranged to releasably hold said cover plate, said gib, and said second side plate mutually stationary in a direction parallel with said axis when said cover plate is in said secured engagement.

14. The tooling module according to claim 13 wherein said first, second, third, and fourth surfaces define said opening and are in slip fit engagement with surfaces of said punch and die assemblies.

15. The tooling module according to claim 14 wherein said opening is of rectangular cross section.

16. The tooling module according to claim 13 wherein said gib is a light press fit within said space between said second and second mating dovetail halves and arranged so that it is removable from said space by application of a specific force to said gib in its longitudinal direction parallel with said axis so that said gib moves in said direction, said specific force being sufficient to overcome the friction of said light press fit.

17. The tooling module according to claim 16 wherein said specific force is between about one pound and about ten pounds.

18. The tooling module according to claim 13 wherein said means for releasably holding includes a hole in each of said cover plate and said gib and a hole in said second side plate, said three holes arranged to be in mutual communication and alignment when said cover plate is in said secured engagement, and a pin disposed within said three holes in slip fit engagement therewith.

19. The tooling module according to claim 18 wherein said pin includes a feature thereon that engages a shoulder in said hole in said second side member.

20. The tooling module according to claim 19 wherein said feature on said pin is a spring loaded ball projecting from a side of said pin and said shoulder is an end of a bushing pressed into said hole.

21. The tooling module according to claim 13 wherein said first and second side plates each have a mounting surface that is parallel with said first surface, and said fourth surface of said cover plate is in engagement with said mounting surfaces, said cover plate including a pair of spaced apart flanges projecting downwardly away from said fourth surface, said pair of flanges straddling said free ends of said first and second side members, each flange having one of said first and second dovetail halves formed therein so that said first and first mating dovetail halves are in opposing relationship and said second and second mating dovetail halves are in opposing relationship.

22. The tooling module according to claim 13 including a top plate attached to a portion of said mounting surfaces of said first and second side plates, said top plate having a locating surface perpendicular to said axis of said opening and arranged so that an end of said cover plate is in locating engagement therewith when said cover plate is attached to said first and second side plates.

23. The tooling module according to claim 22 wherein said top plate includes a fifth surface that is coplanar with said fourth surface of said cover plate when said cover plate is attached to said first and second side plates.

24. The tooling module according to claim 23 wherein said top plate includes a third mating dovetail half and a fourth mating dovetail half spaced therefrom, said third and fourth dovetail halves being substantially identical in shape and size to said first and second mating dovetail halves, said first and third mating dovetail halves being in mating engagement and said second and fourth mating dovetail halves being opposed and spaced apart, and including a gib disposed within the space between said second and fourth dovetail halves and arranged so that there is no appreciable lateral play between said top plate and said first and second side plates.

* * * * *